United States Patent [19]

Sweeny

[11] Patent Number: 4,982,989

[45] Date of Patent: Jan. 8, 1991

[54] AUXILIARY HANDLE

[75] Inventor: Henry D. Sweeny, Kitchener, Canada

[73] Assignee: Swenco Limited, Ontario, Canada

[21] Appl. No.: 499,818

[22] Filed: Mar. 27, 1990

Related U.S. Application Data

[63] Continuation-in-part of Ser. No. 368,796, Jun. 20, 1989, Pat. No. 4,932,702.

[30] Foreign Application Priority Data

May 4, 1989 [CA] Canada ..... 598728

[51] Int. Cl.[5] ..... A45C 13/26; B65D 33/06

[52] U.S. Cl. ..... 294/171; 383/13

[58] Field of Search ..... 294/137, 153, 154, 156, 294/166, 170, 171; 16/110 R, 114 R, 114 B, DIG. 12; 220/94 R, 96; 229/117.09, 117.19, 117.23–117.25; 383/6, 13, 25, 29

[56] References Cited

U.S. PATENT DOCUMENTS

| | | | |
|---|---|---|---|
| 1,576,546 | 3/1926 | Ransom . | |
| 2,684,797 | 7/1954 | Schulte . | |
| 2,846,714 | 8/1958 | Charlick . | |
| 3,083,366 | 3/1963 | Franges | 294/171 |
| 3,912,140 | 10/1975 | Franges | 294/171 X |
| 4,071,063 | 1/1978 | Russell | 294/171 X |
| 4,590,640 | 5/1986 | Enersen . | |

FOREIGN PATENT DOCUMENTS

| | | | |
|---|---|---|---|
| 2840676 | 4/1980 | Fed. Rep. of Germany | 294/171 |
| 1371920 | 7/1963 | France | 294/171 |
| 873710 | 7/1961 | United Kingdom . | |
| 911948 | 12/1962 | United Kingdom . | |
| 2147200 | 5/1985 | United Kingdom | 294/171 |
| 2153213 | 8/1985 | United Kingdom | 294/171 |
| 2202135 | 9/1988 | United Kingdom | 294/171 |

*Primary Examiner*—Johnny D. Cherry

*Attorney, Agent, or Firm*—Jones, Tullar & Cooper

[57] ABSTRACT

An auxiliary handle for use with containers such as bags, pails, cans or cardboard cartons having handle portions included therewith has a longitudinally arcuate base portion and a pair of side walls converging upwardly from opposite sides of the base portion. A generally triangular rib extends inwardly from the inner surface of one side wall and is interleaved with a pair of similar ribs on the inner surface of the other side wall. The outer wall or bottom surface of the base portion has transverse finger-receiving recesses therein. The auxiliary handle fits over the handle portion of the container and helps distribute the weight of the container more evenly to ease the load on the person carrying the container. The interleaved ribs prevent inadvertent release of the auxiliary handle from the container handle.

5 Claims, 2 Drawing Sheets

AUXILIARY HANDLE

This is a continuation-in-part of copending commonly assigned U.S. patent application Ser. No. 07/368,796 filed June 20, 1989, now U.S. Pat. No. 4,932,702.

The present invention relates to an auxiliary handle for use with containers such as cans, pails or bags.

BACKGROUND OF THE INvENTION

Flexible plastic bags are used extensively to carry goods of many varieties. They are found in grocery stores where recently-purchased groceries are packed in wicketed plastic handle bags for transport to the consumer's residence. They are also used as original packages for granular material such as pet food, fertilizers and salt. In the latter instances the bag may contain material weighing 20 kilograms or more. The material from which such bags are made is very strong and such bags usually include a punched-out opening at the top through which the purchaser can insert his hand so that he can carry the bag suspended at the end of his arm. Anyone who has carried a heavy bag of fertilizer, salt or groceries in this manner knows that it does not take very long for the bag handle to cut into the hand to, at the very least, make the carrying of the bag an uncomfortable chore. That is because the bag material is very thin and the load is concentrated along a very narrow line across the palm or fingers of the person carrying the bag.

Other heavy articles are often carried by purchasers or users via handles already provided on the articles. Paint cans, for example, have a thin wire-type bail or handle and the carrying thereof for large distances can be very uncomfortable. Similarly, other products of a bulk or heavy nature (e.g., drywall compound) come in large plastic pails provided with a wire-type bail or possibly a narrow flexible plastic handle. These products also are uncomfortable to carry over a large distance.

SUMMARY OF THE INvENTION

The present invention overcomes the problems encountered above by providing an auxiliary handle into which the handle of a bag or other container can be inserted and which more evenly distributes the container's load in the carrier's hand. The auxiliary handle of this invention includes finger recesses into which the carrier's fingers naturally fall and there is a smooth angled side wall against which the carrier's palm can rest. That side wall can also carry suitable indicia of an advertising or product identification nature if desired. The side walls of the auxiliary handle angle inwardly and are provided with vertically extending internal ribs which serve to retain the auxiliary handle on the container's handle or handles in the event that the container is temporarily released from the carrier's hand, as for example if the carrier sets the container on the ground while fumbling for his car keys.

The broad base of the auxiliary handle makes it easy to carry more than one container with the same handle. This can be especially important with grocery bags since the purchaser often is faced with carrying a large number of bags away from a grocery store to his car or home and will welcome anything that makes his task easier.

The auxiliary handle of this invention can be used over and over again as it is made from a strong plastics material. It can be molded in any colour and could be a retail product or a promotional product. It can be used with plastic handled bags; it could also be used with paper shopping bags that have rope or cord-type handles; or it can be used with containers such as cans or pails having a bail-type handle. There is sufficient flexibility in the side walls of the auxiliary handle to permit the passage between the ribs of handles that are thicker than the normal minimum spacing between the ribs.

Two embodiments of the present invention are disclosed herein. The first utilizes narrow straight ribs on the inside surface of the side walls, which ribs extend from the inner surface to adjacent the upper edges of the side walls, the ribs on one side wall being opposite the ribs of the other side wall and defining a narrow gap therebetween at their point of closest approach. This embodiment, as defined in patent application Ser. No. 07/368,796, is particularly suited for containers that have relatively "thick" handles such as cardboard cartons and pails. The gap between the ribs is usually small enough to prevent the auxiliary handle from falling away from such container handles if it is released by the user, as when he temporarily places the container on the ground or a table.

There are instances when the auxiliary handle of the first embodiment is perhaps somewhat inconvenient to use, as with containers having extremely thin handles. With some plastic bags for example the auxiliary handle of the first embodiment might fall away from the bag handle if released due to the "large" gap between the ribs (large in comparison to the thickness of the bag material). The second embodiment of this invention solves that problem by using ribs on the side walls that interengage such that in use it is impossible for the auxiliary handle to fall away from the container handle under its own weight. A conscious effort is required on the part of the user to pass the container handle past the ribs of the second embodiment when attaching the auxiliary handle to the container handle and when releasing the auxiliary handle from the container handle. There is sufficient flexibility in the side walls of the auxiliary handle to permit passage of a container handle past the ribs of this embodiment. Preferably a single rib on one side wall is receivable between a pair of similar ribs on the other side wall, there being a small zone of overlap between the nose portions of the opposing ribs to effectively prevent unwanted passage of a container handle past the ribs.

DESCRIPTION OF THE PREFERRED EMBODIMENT

Figure 1:
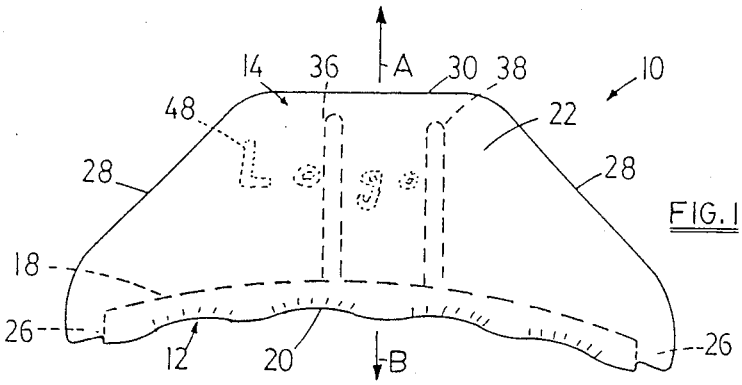
FIG. 1 shows a side view of a first embodiment of the auxiliary handle of this invention.
Figure 2:
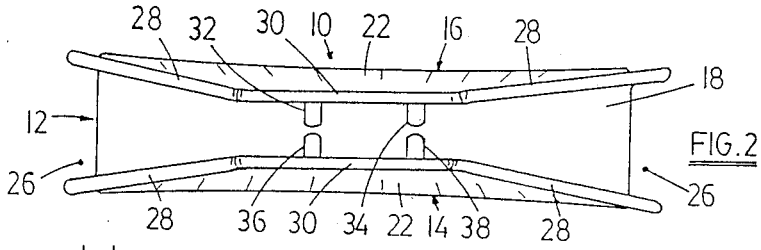
FIG. 2 shows a plan view of the handle of FIG. 1.
Figure 3:
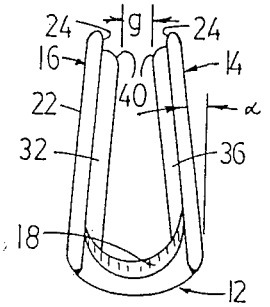
FIG. 3 shows an end view of the handle of FIG. 1.

The first auxiliary handle of this invention is illustrated in FIGS. 1-5 of the drawings under reference number 10. The handle includes a longitudinally arcuate base portion 12 and a pair of upstanding side walls 14,16. As seen in FIGS. 1 and 3, the base portion 12 is relatively thick and includes an inner surface 18 which is both longitudinally curved (see FIG. 1) and transversely curved (see FIG. 3). The bottom surface of the base portion 12 includes a plurality of longitudinally adjacent finger-receiving recesses 20 each of which is both longitudinally arcuate (concave) and transversely curved at the side edges thereof for the comfort of the user. Four such finger-receiving recesses are provided.

The side walls 14,16 extend upwardly from each side of the base portion, the outer surface 22 of each wall merging smoothly with finger-receiving recesses 20 and the inner surface 24 of each wall merging smoothly with the inner surface 18 of the base portion 12. As seen in FIGS. 1 and 2 each side wall 14,16 extends beyond the end of the base portion at 26 and includes upwardly and inwardly sloping edges 28 and a top edge 30.

Extending downwardly within the auxiliary handle 10 are four narrow ribs 32,34,36,38. The ribs have the same thickness as the side walls 14,16. They start a short distance below the top edge 30 of each side wall and extend downwardly to the inner surface 18.

As seen in FIG. 3 the side walls 14,16 converge upwardly from the base portion 12 such that there is a narrow gap "g" between the ribs 32,36 and 34,38 on the order of 2 mm at the point of closest approach. The angle $\alpha$, representing the angle of convergence of the side walls, is desirably in the order of 10°. The ribs are elongated in the vertical direction; i.e., in the direction of convergent of the side walls 14, 16, as most clearly illustrated in FIGS. 1 and 3.

The convergence of the side walls 14,16 is not, as would be expected, achieved in the molding process per se. Clearly, it would be difficult to create a suitable mold so that the resulting product would have the desired shape but could still be removed from the mold without damaging the product. In fact the product of this invention is molded with side walls 14,16 parallel to each other, thereby allowing the mold halves to move smoothly away from each other along the arrows A,B in FIG. 1. By maintaining the precise geometry of the part, as described herein, by selecting the correct material, and by controlling the mold parameters of time, temperature of extrudate, and cooling, the side walls will shrink consistently towards each other to the position shown in FIG. 3. The degree of convergence will depend on the relative amounts of material in the side walls 14,16, the ribs 32,34,36 and 38, and the base portion 12.

As previously indicated, there is a small amount of lateral flexibility associated with the side walls 14,16. Although the gap "g" is quite small, the flexibility associated with the side walls permits the walls to be separated slightly, thereby increasing the gap "g" so as to permit bag handles of a thickness greater than the gap "g" to pass between the ribs 32,36 and 34,38. This is very useful when one auxiliary handle is used with a number of bags, when a bag having a rope or cord-type handle is to be carried, or even when the auxiliary handle is used to carry a container, such as a paint can, having a metal or plastic bail or handle. In the latter instances, the rounded upper corner of each rib, as at 40, facilitates the entry of a handle or bail between the ribs, effectively camming the ribs and side walls apart until the bail or handle has passed into the interior of the auxiliary handle.

Figure 5:
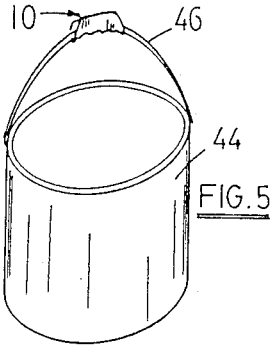
FIG. 5 shows the handle of FIG. 1 in use with a paint can.
Figure 4:
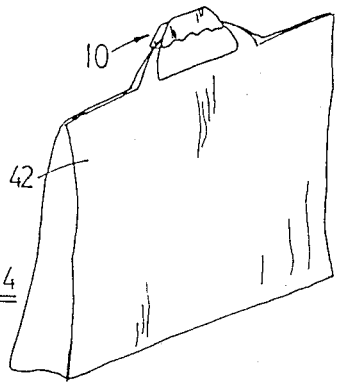
FIG. 4 shows the handle of FIG. 1 in use with a loaded bag.

FIGS. 4 and 5 show the auxiliary handle 10 in position on two types of container, a grocery bag 42 in FIG. 4 and a paint can 44 in FIG. 5. It is readily seen that in each case the auxiliary handle provides a relatively wide surface having comfortable finger-receiving recesses which can be engaged by a person's hand and fingers to ease the burden of carrying a heavy load in the container. Also, when the load is carried with the fingers engaging the recesses, 20 one of the side walls 14,16 will be against the palm of the person's hand and this provides additional support by ensuring that the hand is in the optimum orientation for carrying and by preventing any unwanted rotation or twisting of the auxiliary handle relative to the container's handle. This latter effect is most desirable with wire-like bails such as the bail 46 on paint can 44.

Finally, as indicated previously, the auxiliary handle 10 of this invention is ideally suited for advertising purposes since the relatively large expanse of the outer surface 22 of each side wall 14,16 may carry a store's logo (48 in FIG. 1) molded into the surface 22 during production or may carry a label hot stamped or transfer printed thereon after production with such label carrying whatever information is deemed appropriate. Also, the auxiliary handle can be molded in any colour such as a particular store's or producer's distinctive colours so as to readily associate the auxiliary handle with that store or producer. Since the auxiliary handle of this invention is relatively inexpensive to manufacture, it could be given away as part of a promotion or it could be sold for small profit adjacent check-out counters in retail stores.

A second embodiment of the auxiliary handle of this invention is seen in FIGS. 6-10 of the drawings under reference number 50. This handle has a longitudinally arcuate base portion 52 and a pair of upstanding side walls 54,56. There is also an inner surface 58 which is both longitudinally curved (see FIG. 6) and transversely curved (see FIG. 8). The bottom surface of the base portion 52 includes a plurality of longitudinally adjacent, finger-receiving recesses 60, each of which is both longitudinally arcuate (concave) and transversely curved at the side edges thereof for the comfort of the user. As illustrated, four such finger-receiving recesses are provided.

The side walls 54,56 extend upwardly from each side of the base portion, the outer surface 62 of each side wall merging smoothly with the recesses 60, and the inner surface 64 of each wall merging smoothly with the inner surface 58 of the base portion 52. The end edges 66 of the side walls are flush with the adjacent end of the base portion 52 and there are upwardly and inwardly sloping edges 68 and a generally straight top edge 70.

The inner walls of the auxiliary handle are provided with interengaging ribs which close the handle and prevent inadvertent release from a container handle. A first, generally triangular rib 72 is integrally molded on one wall 54 so as to project inwardly therefrom at right angles thereto adjacent the top edge 70.

Figure 9:
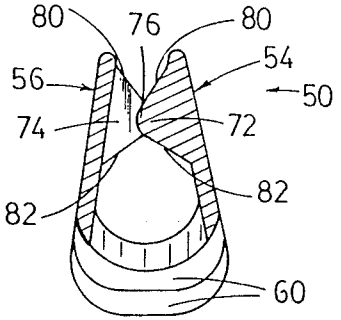
FIG. 9 shows a cross-section taken on the line 9—9 of FIG. 7.
Figure 8:
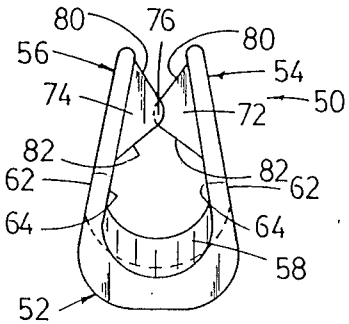
FIG. 8 shows an end view of the handle of FIG. 6.
Figure 7:
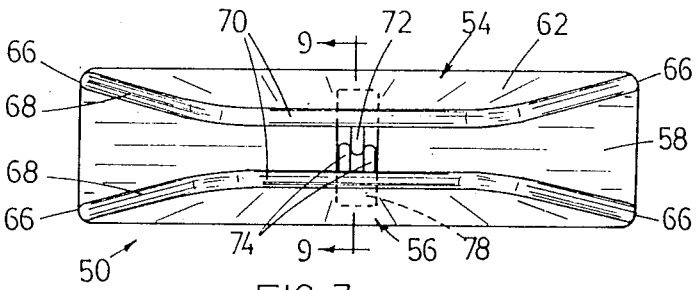
FIG. 7 shows a plan view of the handle of FIG. 6.
Figure 6:
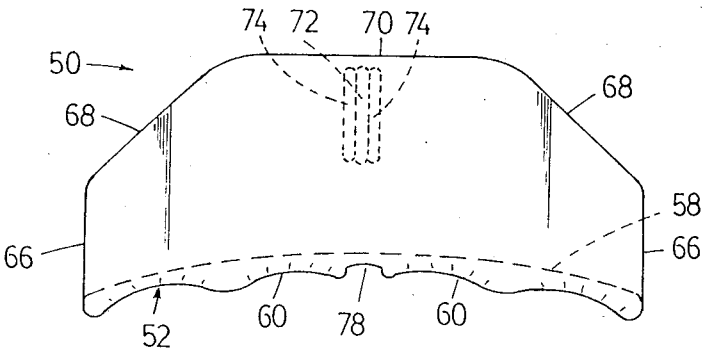
FIG. 6 shows a side view of a second embodiment of the auxiliary handle of this invention.

A pair of second generally triangular ribs 74 integrally molded on the other side wall 56 project inwardly therefrom at right angles thereto adjacent top edge 70. The ribs 74 are positioned so that one will be on each side of the rib 72, the spacing between the ribs 74 being just sufficient to permit the rib 72 to enter therein as shown in FIG. 7. As seen in FIGS. 8 and 9, each rib is shown as being elongated in the direction of convergence of the walls 54, 56, and as having a rounded nose portion 76, there being an overlap of the nose portion 76 of rib 72 with the nose portions 76 of ribs 74 when the auxiliary handle is in its normal, unstressed condition as illustrated in FIGS. 6–9.

As with the first embodiment, the side walls 54,56 converge upwardly from the base portion 52 at an angle of convergence of about 10°. Also as with the first embodiment, the auxiliary handle of the second embodiment is molded with the side walls 54,56 parallel to each other to allow the mold halves to move smoothly away from each other. In order to mold the ribs 72,74 as shown, however, it is necessary to provide a rectangular opening 78 in the base portion 52 directly below the ribs to permit an appropriate molding insert to enter the interior of the auxiliary handle during molding to form the lower part of each rib. A complementary portion of the upper mold half would form the upper part of each rib. In accordance with the principles established with the first embodiment, the side walls will shrink consistently towards each other as the molded part cools, to the position shown in FIG. 8. Thus, when the part is initially molded, there will be no interleaving or interengagement of the ribs 72,74, the side walls being parallel to each other. However, with cooling, the side walls will converge, bringing the nose portions 76 into the interleaved position of FIG. 8.

When using the auxiliary handle of this invention, the user will be able to easily move the side walls slightly apart either by hand or by forcing the sloping upper edges 80 of the ribs against the container handle. If the side walls are moved apart by hand, the ribs will be released from the interleaved position and the container handle will pass thereby towards the inner surface 58. Once the container handle is in position, the side walls are released to spring back to the position of FIG. 8. with the nose portions 76 interleaved and preventing any inadvertent separation of the auxiliary handle from the container handle. If the upper edges 80 of the ribs are pushed against a fairly rigid container handle, such action will cam the ribs and side walls apart so that the container handle can pass by the nose portions into the interior of the auxiliary handle. Thereafter, the auxiliary handle of the second embodiment is used in the same manner as the auxiliary handle of the first embodiment.

The upwardly sloping lower edges 82 of the ribs 72,74 facilitate removal of the auxiliary handle from the container handle in a reversal of the technique described hereinabove.

The auxiliary handle of this invention provides an economical effective aid for shoppers or other individuals who often carry heavy loads in bags, pails or cans. It is comfortable and easy to use and meets a definite need in the marketplace. While a preferred form of the invention has been disclosed herein, it is understood that a skilled practitioner could effect changes to the product without departing from the spirit of the invention and, accordingly, the protection to be afforded the invention is to be determined from the scope of the claims appended hereto.

The embodiments of the invention in which an exclusive property or privilege is claimed are defined as follows:

1. An auxiliary handle for use with a container having its own handle portion comprising: narrow base means having a longitudinally generally downwardly concave outer surface, a longitudinally generally arcuate inner surface generally parallel to said outer surface, and a plurality of longitudinally adjacent and concave transversely extending finger-receiving recesses in said outer surface; a pair of planar side wall means converging upwardly away from said base means and having upper free edges, with said base means inner surface being located between said wall means; a first narrow rib extending from an inner surface of one wall means towards the other wall means; a pair of second narrow ribs extending from an inner surface of said other wall means towards said one wall means, each of said ribs being elongated in the direction of convergence of said wall means; and a portion of said first rib being interleaved with a portion of said second ribs; whereby said auxiliary handle can be engaged with a container handle portion by spreading said wall means to separate said first rib from said second ribs, passing such handle portion past the separated ribs, and bringing such handle portion into contact with said inner surface, a person then being able to better support the container and a load therein by gripping the auxiliary handle rather than the container handle portion itself, the interleaved ribs preventing inadvertent release of the auxiliary handle from the container handle portion.

2. The auxiliary handle of claim 1 wherein said base means inner surface is transversely concave along the length thereof.

3. The auxiliary handle of claim 1 wherein each of said ribs is generally triangular and is positioned adjacent the free end of its respective wall means.

4. The auxiliary handle of claim 1 wherein each of said ribs has a downwardly sloping upper edge and upwardly sloping lower edges, the upper and lower edges meeting at a rounded nose portion, the interleaved first and second ribs overlapping with each other in the vicinity of their respective nose portions.

5. An auxiliary handle for use with a container having its own portion comprising: narrow base means having a longitudinally generally downwardly concave outer surface, a longitudinally generally arcuate inner surface generally parallel to said outer surface, and a plurality of longitudinally adjacent and concave transversely extending finger-receiving recesses in said outer surface; a pair of planar side wall means converging upwardly away from said bas means and having upper free edges, with said base means inner surface being located between said wall means; a first narrow rib extending from an inner surface of one wall means towards the other wall means; a pair of second narrow ribs extending from an inner surface of said other wall means towards said one wall means, a portion of said first rib being interleaved with a portion of said second ribs; each of said ribs having a downwardly sloping upper edge and an upwardly sloping lower edge, with the upper and lower edges meeting at a rounded nose portion, the interleaved first and second ribs overlapping each other in the vicinity of their respective nose portions, whereby said auxiliary handle can be engaged with a container handle portion by spreading said wall means to separate said first rib from said second ribs, passing such handle portion past the separated ribs, and bringing such handle portion into contact with said inner surface, a person then being able to better support the container and a load therein by gripping the auxiliary handle rather than the container handle portion itself, the interleaved ribs preventing inadvertent release of the auxiliary handle from the container handle portion.

* * * * *